US008781341B2

(12) United States Patent
Hymas et al.

(10) Patent No.: US 8,781,341 B2
(45) Date of Patent: Jul. 15, 2014

(54) DETERMINATION OF EFFECTIVE AMOUNT OF REMAINING LIFE OF TONER CARTRIDGE

(71) Applicant: Hewlett-Packard Development Company, L. P., Houston, TX (US)

(72) Inventors: Scott K Hymas, Meridian, ID (US); Michael Clinton Allyn, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 57 days.

(21) Appl. No.: 13/623,727

(22) Filed: Sep. 20, 2012

(65) Prior Publication Data

US 2014/0079412 A1 Mar. 20, 2014

(51) Int. Cl.
*G03G 15/08* (2006.01)

(52) U.S. Cl.
USPC ..... 399/24; 399/25; 399/26; 399/27

(58) Field of Classification Search
CPC ..... G03G 15/55
USPC ..... 399/24–27
See application file for complete search history.

(56) References Cited

U.S. PATENT DOCUMENTS

| | | | | |
|---|---|---|---|---|
| 5,548,374 | A * | 8/1996 | Iguchi et al. | 399/24 |
| 5,636,032 | A * | 6/1997 | Springett | 358/296 |
| 5,678,125 | A * | 10/1997 | Kutsuwada et al. | 399/26 |
| 6,175,375 | B1 * | 1/2001 | Able et al. | 347/132 |
| 6,226,463 | B1 * | 5/2001 | Phillips et al. | 399/24 |
| 6,594,451 | B2 * | 7/2003 | Kakeshita et al. | 399/24 |
| 6,868,238 | B2 * | 3/2005 | Rodriguez | 399/24 |
| 6,914,696 | B1 | 7/2005 | Kojima et al. | |
| 6,931,218 | B2 | 8/2005 | Kakeshita et al. | |
| 6,961,527 | B2 | 11/2005 | Matsuguma et al. | |
| 7,058,320 | B2 | 6/2006 | Yamamoto et al. | |
| 7,200,350 | B2 * | 4/2007 | Agata et al. | 399/223 |
| 7,734,200 | B2 | 6/2010 | Sugiyama et al. | |
| 2002/0150410 | A1 * | 10/2002 | Matsuda et al. | 399/263 |
| 2004/0213592 | A1 * | 10/2004 | Rodriguez | 399/24 |
| 2005/0069334 | A1 * | 3/2005 | Hashimoto et al. | 399/25 |
| 2008/0226310 | A1 * | 9/2008 | Togami | 399/27 |
| 2008/0304837 | A1 * | 12/2008 | Park | 399/25 |
| 2009/0201330 | A1 * | 8/2009 | Azami et al. | 347/15 |
| 2010/0202787 | A1 * | 8/2010 | Satonaga et al. | 399/24 |
| 2012/0230730 | A1 * | 9/2012 | Ogino | 399/119 |

OTHER PUBLICATIONS http://www.ahealey.co.uk/PDFs/counter%20check.pdf ~ "Colour Copier Drum/Toner counter check" ~ retrieved Jul. 2012.

* cited by examiner

*Primary Examiner* — G. M. Hyder

(57) ABSTRACT

An image forming system includes at least one toner cartridge, an image forming unit, and a cartridge life determination module. The toner cartridge may include toner and at least one component. The image forming unit may selectively form an image in one of a low coverage mode and a high coverage mode such that a greater amount of the toner is used in the high coverage mode than the low coverage mode in a formation of the respective image. The cartridge life determination module may determine an amount of remaining life of the toner, an amount of remaining life of the at least one component, and an effective amount of remaining life of the at least one toner cartridge based on the amount of remaining life of the toner and the amount of remaining life of the at least one component.

18 Claims, 7 Drawing Sheets

DETERMINATION OF EFFECTIVE AMOUNT OF REMAINING LIFE OF TONER CARTRIDGE

BACKGROUND

Image forming systems such as laser printers may include various print modes and a toner cartridge such as an all-in-one toner cartridge. For example, a monochrome laser printer may include one toner cartridge including black toner. A color laser printer may include a plurality of toner cartridges having a respective color toner. The toner cartridges may have a lifespan dependent on the expiration of one of its components and/or toner therein.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming systems such as laser printers may include various print modes and a toner cartridge such as an all-in-one toner cartridge (toner cartridge). The various print modes may include a low coverage print mode and a high coverage print mode. That is, a low coverage mode is a print mode in which an image is formed using a lower amount of toner than the amount of toner that would be used to form the same image in a high coverage mode. In other words, the high coverage mode is a print mode in which an image is formed using a higher amount of toner than the amount of toner that would be used to form the same image in the low coverage mode. Generally, the respective image may be formed of a higher image quality when printed in the high coverage print mode, rather than the low coverage mode. The respective toner cartridge of the image forming system may have a respective lifespan that may be dependent on the expiration of one of its components and/or toner therein. That is, an effective amount of remaining life of the toner cartridge may be dependent on a respective component and/or toner of the toner cartridge which is first to expire. Periodically, the toner cartridge may expire (e.g., effective amount of remaining life of zero) due to expiration of one of its components with unused toner in the toner cartridge, regardless of the print mode used. Thus, an ability to use such unused toner in forming images having a higher image quality in the high coverage mode, rather than the low coverage mode, without reducing the effective amount of remaining life of the toner cartridge may have been decreased.

In examples, an image forming system includes at least one toner cartridge, an image forming unit, and a cartridge life determination module. The toner cartridge may include toner and at least one component. The image forming unit may selectively form an image in one of a low coverage mode and a high coverage mode such that a greater amount of the toner is used in the high coverage mode than the low coverage mode in a formation of the respective image. The cartridge life determination module may determine an amount of remaining life of the toner, an amount of remaining life of the at least one component, and an effective amount of remaining life of the at least one toner cartridge based on the amount of remaining life of the toner and the amount of remaining life of the at least one component. Thus, an ability to use toner that may otherwise be stranded in the toner cartridge in forming images having a higher image quality in the high coverage mode, rather than the low coverage mode, without reducing the effective amount of remaining life of the toner cartridge may be increased. Consequently, an amount of unused toner residing in the toner cartridge upon its expiration due to expiration of one of its components may be reduced.

Figure 1:
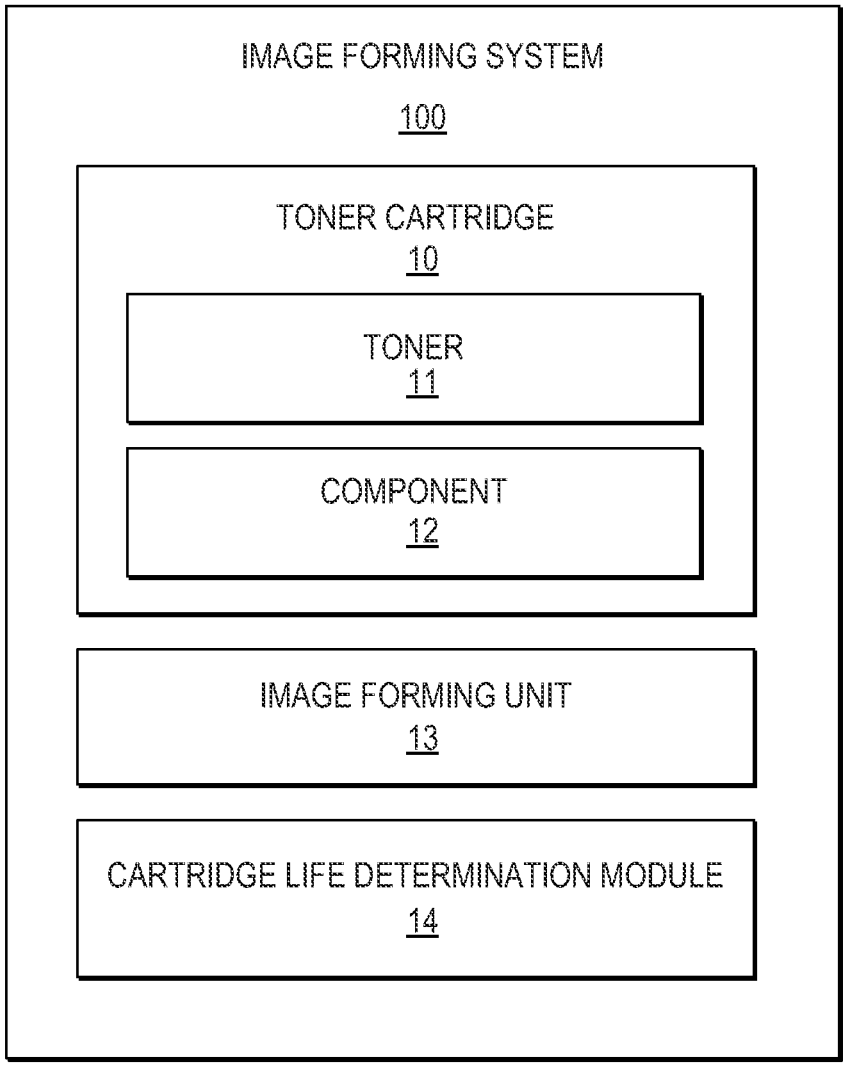
FIG. 1 is a block diagram illustrating an image forming system according to an example.

FIG. 1 is a block diagram illustrating an image forming system according to an example. Referring to FIG. 1, in some examples, an image forming system 100 includes at least one toner cartridge 10, an image forming unit 13, and a cartridge life determination module 14. The toner cartridge 10 may include toner 11 and at least one component 12. In some examples, the at least one component 12 may include a plurality of components. For example, the component 12 may include a photosensitive drum and/or a developer member. For example, the photosensitive drum such as an organic photo-conductive drum (OPC) may enable a latent image to be formed thereon and a developer member such as a developer roller may provide toner 11 to the latent image to form a developed image on the photosensitive drum. The image forming unit 13 such as a laser may selectively form an image in one of a low coverage mode and a high coverage mode.

Referring to FIG. 1, in some examples, a low coverage mode may correspond to a print mode in which an image is formed using a lower amount of toner than the amount of toner that would be used to form the same image in a high coverage mode. For example, with respect to a respective image formed on a substrate, a lesser amount of the substrate would be covered by toner in the low coverage mode than the high coverage mode. A high coverage mode may correspond to a print mode in which an image is formed using a higher amount of toner than the amount of toner that would be used to form the same image in a low coverage mode. For example, with respect to a respective image formed on a substrate, a greater amount of the substrate would be covered by toner in the high coverage mode than the low coverage mode.

Referring to FIG. 1, in some examples, the cartridge life determination module 14 may determine an amount of remaining life of the toner 11, an amount of remaining life of the at least one component 12, and an effective amount of remaining life of the at least one toner cartridge 10 based on the amount of remaining life of the toner 11 and the amount of remaining life of the at least one component 12. For example, the effective amount of remaining life of the at least one toner cartridge 10 may correspond to the shortest amount of remaining life of the respective components and toner 11 of the toner cartridge 10. That is, the effective amount of remaining life of the toner cartridge 10 is dependent on the respective component 12 and/or toner 11 of the toner cartridge 10 which is first to expire.

Figure 2:
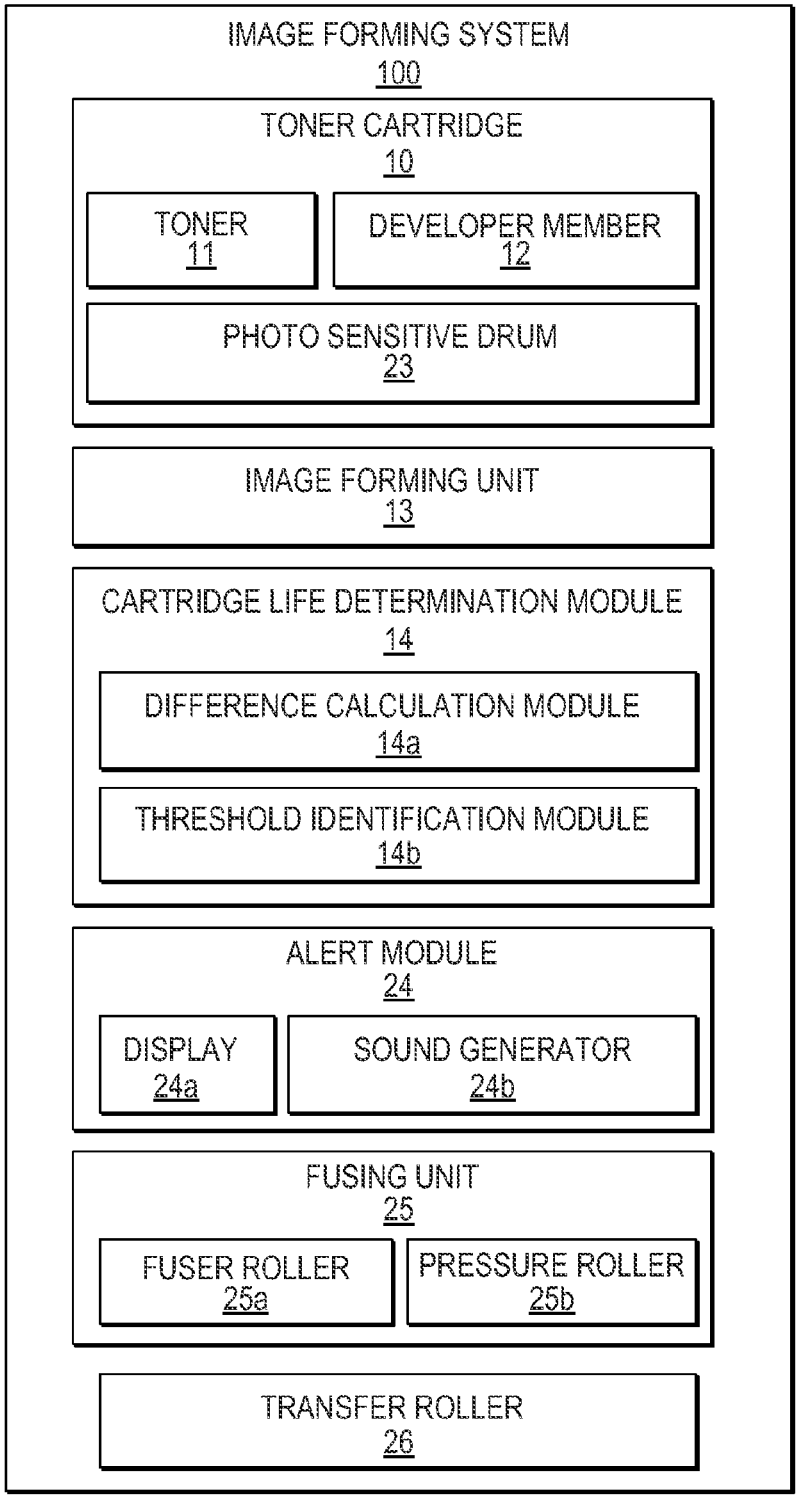
FIG. 2 is a block diagram illustrating the image forming system of FIG. 1 according to an example.

FIG. 2 is a block diagram illustrating the image forming system of FIG. 1 according to an example. Referring to FIG. 2, in some examples, the image forming system 100 includes at least one toner cartridge 10, an image forming unit 13, and a cartridge life determination module 14 as previously disclosed with respect to FIG. 1. In some examples, the toner cartridge 10 may include toner 11, a developer member 22, and a photosensitive drum 23. In some examples, the cartridge life determination module 14 may also include a difference calculation module 14*a* and a threshold identification module 14*b*. The difference calculation module 14*a* may calculate a difference between the amount of remaining life of the toner 11 and the amount of remaining life of the at least one component 12. The threshold identification module 14*b* may identify whether the difference corresponds to a threshold value. For example, the threshold value may be set corresponding to a condition in which the amount of remaining life of the toner 11 is at least double the amount of remaining life of the at least one component 12 when the effective remaining life of the at least one toner cartridge 10 is half of its original lifespan.

In some examples, a cartridge life determination module 14, a difference calculation module 14*a* and/or a threshold identification module 14*b* may be implemented in hardware, software including firmware, or combinations thereof. The firmware, for example, may be stored in memory and executed by a suitable instruction-execution system. If implemented in hardware, as in an alternative example, the cartridge life determination module 14, the difference calculation module 14*a* and/or the threshold identification module 14*b* may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the cartridge life determination module 14, the difference calculation module 14*a* and/or the threshold identification module 14*b* may be implemented in a combination of software and data executed and stored under the control of a computing device.

Referring to FIG. 2, in some examples, the image forming apparatus 100 may also include an alert module 24, a fusing unit 25, and a transfer roller 26. The alert module 24 may alert a user to form the respective image in the high coverage mode in response to a determination of the effective amount of remaining life of the at least one toner cartridge 12. For example, the alert module 24 may include a display 24*a* to provide a visual indication to the user to form the respective image in the high coverage mode and a sound generator 24*b* to provide an audio indication to the user to form the respective image in the high coverage mode. The fusing unit 25 may fuse the developed image onto a substrate. For example, the fusing unit 25 may include a fuser roller 25*a* to melt the developed image onto the substrate and a pressure roller 25*b* to direct a substrate toward the fuser roller 25*a*. The transfer roller 26 may enable the developed image to transfer from the photosensitive drum 23 of the toner cartridge 10 to the substrate. For example, the transfer roller 26 may apply a respective charge to a portion of the substrate (e.g., back side) to attract the toner forming the developed image from the photosensitive drum 23 to the substrate.

Figure 3:
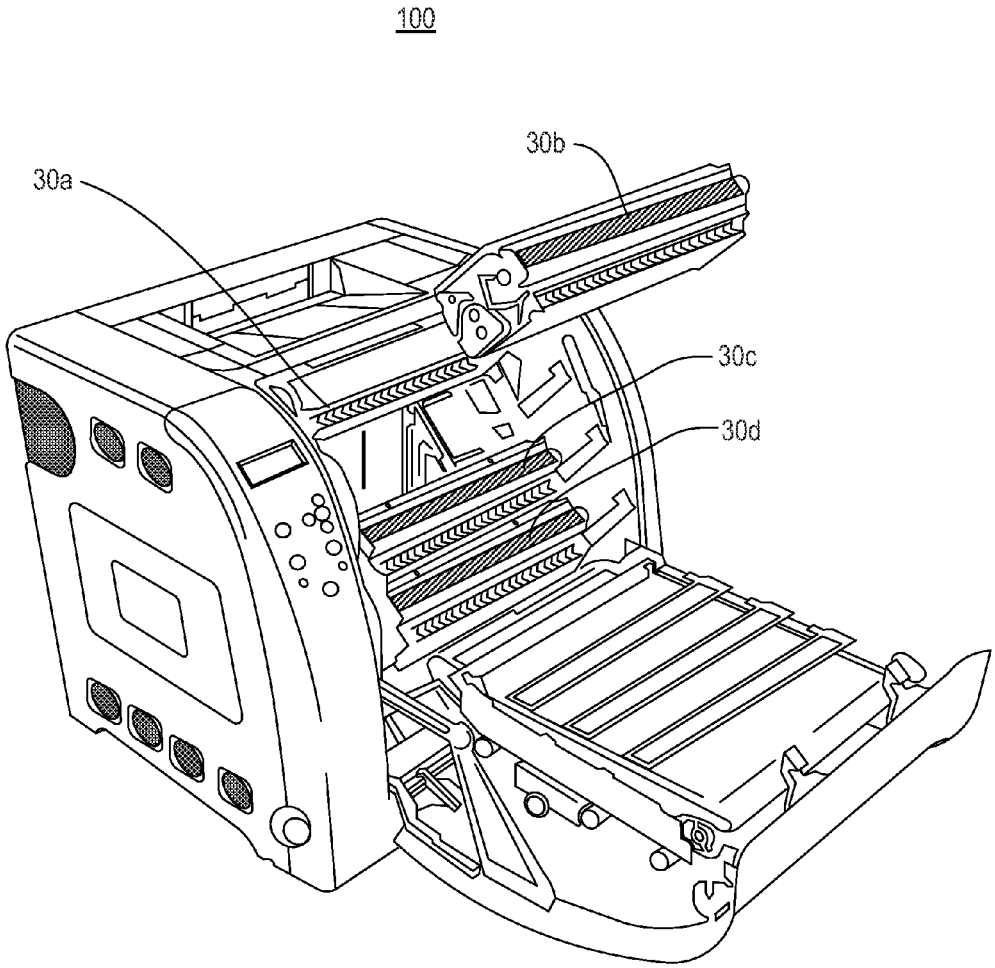
FIG. 3 is a perspective view illustrating the image forming system of FIG. 1 according to an example.

FIG. 3 is a perspective view illustrating the image forming system of FIG. 1 according to an example. Referring to FIG. 3, in some examples, the image forming system 100 may include a color laser printer including a plurality of toner cartridges 30*a*, 30*b*, 30*c* and 30*d*. Each one of the toner cartridges 30*a*, 30*b*, 30*c* and 30*d* may correspond to a respective color and be replaced upon expiration of the respective toner cartridge 30*a*, 30*b*, 30*c* and 30*d*. That is, expiration of the respective toner cartridge 30*a*, 30*b*, 30*c* and 30*d* may correspond to the effective amount of its remaining life being zero. Additionally, in some examples, an alert module 24 (FIG. 2) may be configured to alert the user to form the respective image in the high coverage mode based on a determination of the effective amount of remaining life of each one of the plurality of toner cartridges. For example, when the effective amount of remaining life of each one of the plurality of toner cartridges 30*a*, 30*b*, 30*c*, and 30*d* reach the respective amount, the alert module 24 may alert the user to form the respective image in the high coverage mode based on a determination of the effective amount of remaining life of each one of the plurality of toner cartridges. Alternatively, historical use data of each one the various color toner cartridges 30*a*, 30*b*, 30*c*, and 30*d* may also be used even when an individual toner cartridge has failed to reach the threshold value to determine when to alert module 24 that the user may form the respective image in the high coverage mode.

Figure 4:
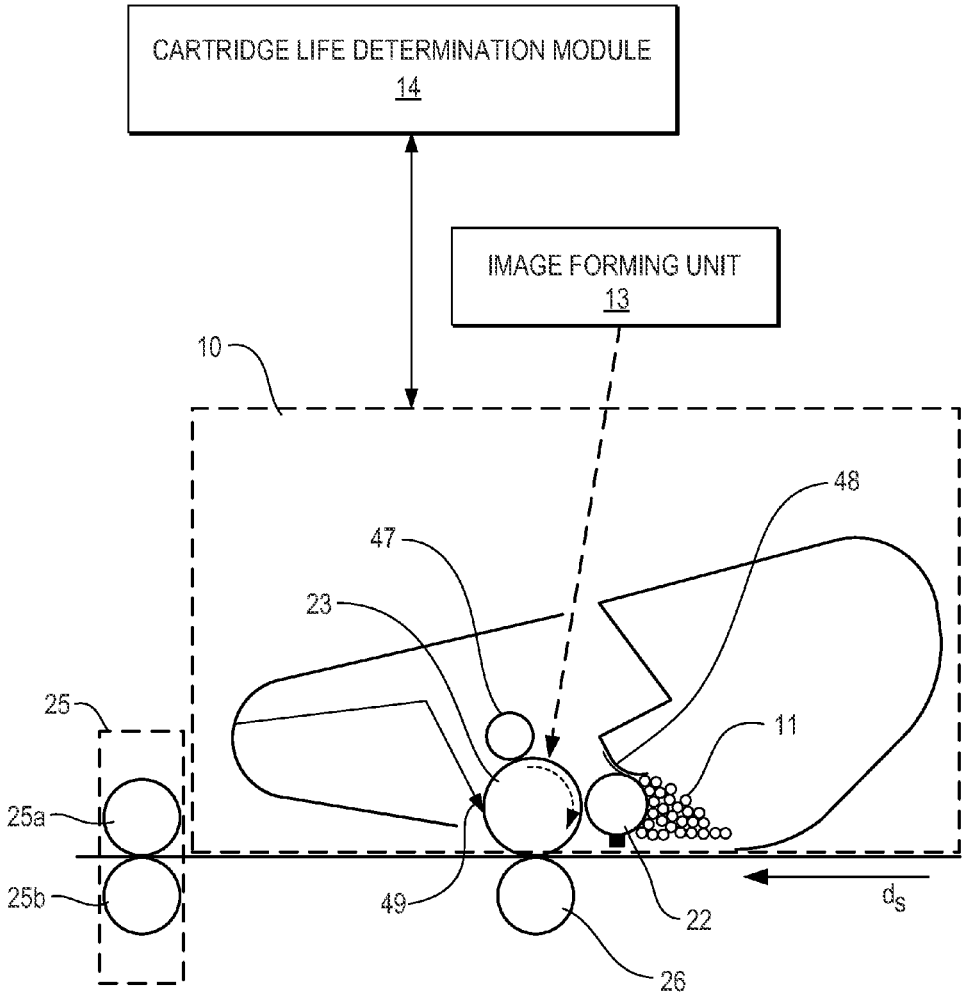
FIG. 4 is a schematic view illustrating a toner cartridge of the image forming system of FIG. 1 according to an example.

FIG. 4 is a schematic view illustrating a toner cartridge usable with the image forming system of FIG. 1 according to an example. Referring to FIG. 4, in some examples, a toner cartridge 10 may include may include toner 11 and components including a photosensitive drum 23 such as an organic photo-conductive (OPC) drum, a developer member 22 such as a developer roller, a charge roller 47, a doctor blade 48 and a wiper blade 49. For example, the charge roller 47 may apply a respective charge to the photosensitive drum 23. An image forming unit 13 such as a laser may emit light onto respective portions of the photosensitive drum 23 to change the respective charge to form a latent image thereon. The developer member 22 may provide toner 11 to the latent image on the photosensitive drum 23 to form a developed image thereon.

For example, the charge of the toner 11 may be opposite to the charge of the latent image and, thus, cause the toner 11 to be attracted to the latent image. The doctor blade 48 may charge the toner 11 and/or regulate an amount of the toner 11 provided to the photosensitive drum 23 from the developer member 22. The wiper blade 49 may wipe the waste including residual toner and/or debris from the photosensitive drum 23 after the image is transferred to a substrate S. The substrate may be transported in a substrate transport direction $d_s$. The image forming system 100 (FIG. 2) may include a cartridge life determination module 14, a transfer roller 26, and a fusing unit 25 having a fuser roller 25*a* and pressure roller 25*b* as previously disclosed with respect to FIG. 2.

Figure 5:
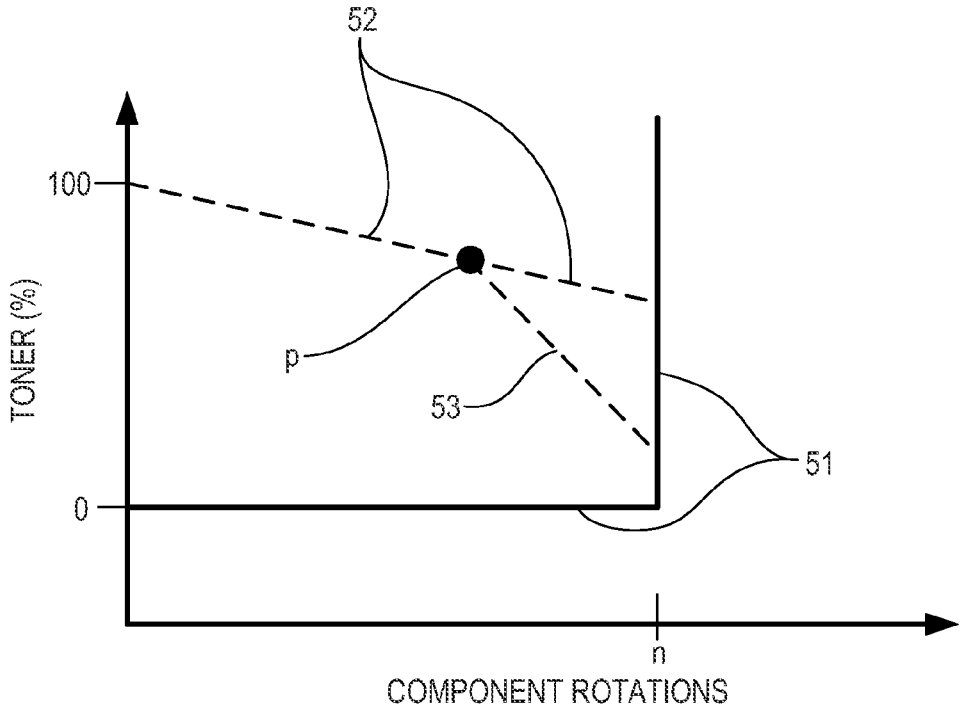
FIG. 5 is a graph illustrating determination of when to alert a user to use a high coverage mode according to an example.

FIG. 5 is a graph illustrating determination of when to alert a user to use a high coverage mode according to an example. Referring to FIGS. 1 and 5, in some examples, a graph includes component rotations along the horizontal (x) axis and percentage of toner 11 to be used for image formation remaining in the toner cartridge 10 (% TONER) along the vertical (y) axis. As illustrated in FIGS. 1 and 5, a first line 51 corresponds to a normal notification of when a remaining life of a toner cartridge 10 is substantially zero (e.g., expired) in an image forming system 100. A second line 52 corresponds to formation of images in a low coverage mode in the image forming system 100. A third line 53 corresponds to formation of images in a high coverage mode from point P in the image forming system 100. Point P is a point when a user may be notified to use the high coverage mode in response to an effective amount of remaining life of the toner cartridge 10 based on the amount of remaining life of the toner 11 and the amount of remaining life of at least one component 12.

For example, with respect to FIGS. 1 and 5, an image forming system 100 may determine that an effective amount of life remaining of the toner cartridge 10 is substantially the same in the high coverage mode and the low coverage mode and notify the user that at point P. That is, as illustrated in FIG. 5, n component rotations result whether a low coverage mode or a high coverage mode was used in the formation of images from the point P to the effective remaining life of the toner cartridge 10 being substantially zero. Thus, a same number of component rotations may be consumed even when the high coverage mode is used in response to the notification, rather than use of the low coverage mode. Accordingly, formation of images in the high coverage mode in response to the user notification may result in forming higher quality images without reducing the effective life of the toner cartridge 10. For example, a component 12 of the toner cartridge 11 may expire before the toner 11 usable for forming images remaining in the toner cartridge 10 runs out.

Figure 6:
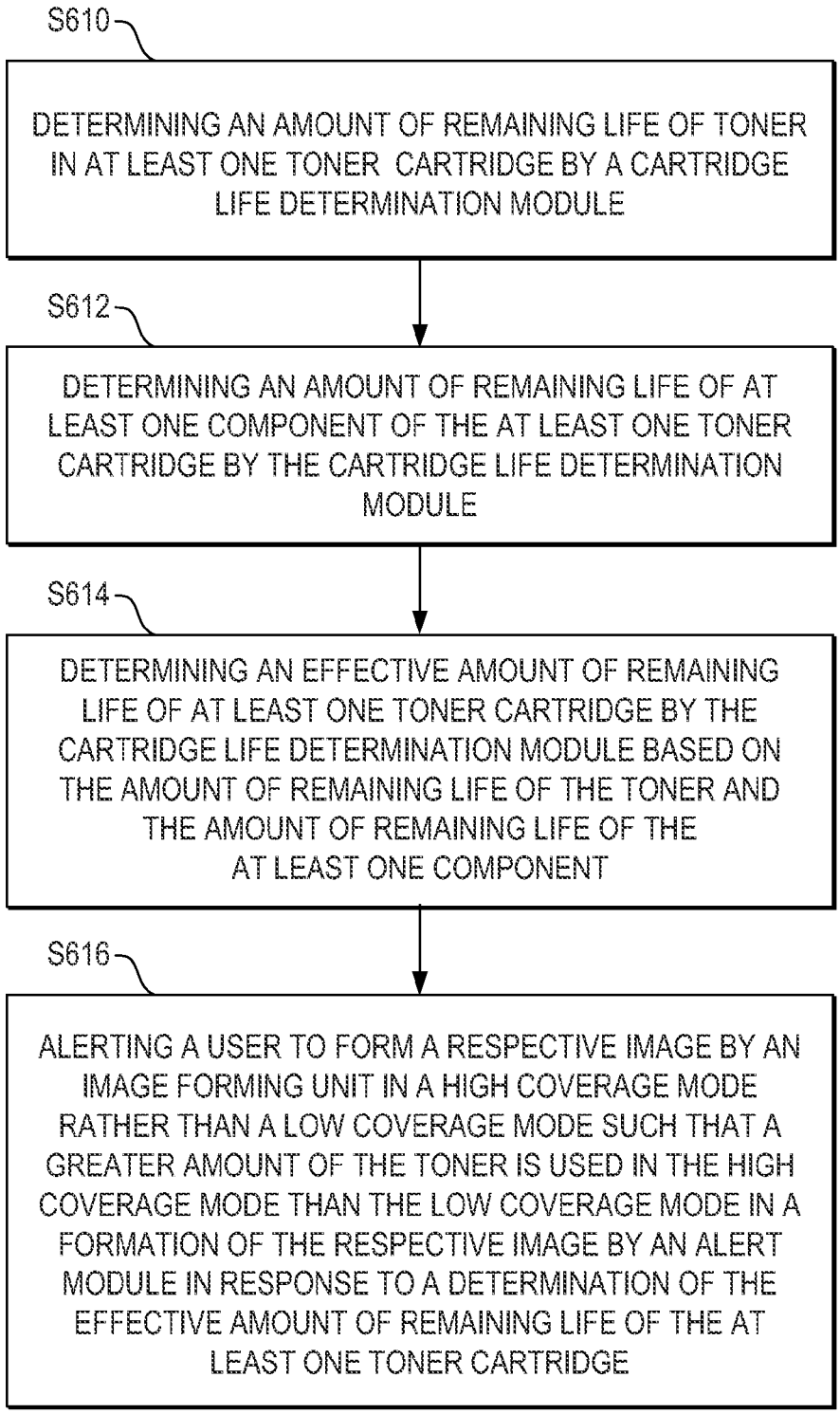
FIG. 6 is a flowchart illustrating a method of alerting a user of an image forming system to form an image in a high coverage mode according to an example.

FIG. 6 is a flowchart illustrating a method of alerting a user of an image forming system to form an image in a high coverage mode according to an example. Referring to FIG. 6, in block S610, an amount of remaining life of toner in at least one toner cartridge is determined by a cartridge life determination module. In block S612, an amount of remaining life of at least one component of the at least one toner cartridge is determined by the cartridge life determination module. In some examples, the at least one component may include a plurality of components. For example, the plurality of components may include a photosensitive drum in which a latent image is formed thereon and/or a developer member to provide toner to the latent image to form a developed image. Additionally, the at least one component may include a developer member in which a latent image is formed thereon and a developer member to provide toner to a latent image to form a developed image on a photosensitive drum and the amount of remaining life of the developer member corresponds to a number of rotations thereof. The at least one component may include a photosensitive drum in which a latent image is formed thereon and the amount of remaining life of the photosensitive drum corresponds to a number of rotations thereof.

In block S614, an effective amount of remaining life of the at least one toner cartridge is determined by the cartridge life determination module based on the amount of remaining life of the toner and the amount of remaining life of the at least one component. For example, a difference may be calculated between the amount of remaining life of the toner and the amount of remaining life of the at least one component by a difference calculation module. Additionally, whether the difference corresponds to a threshold value may be identified by a threshold identification module. In some examples, whether an effective amount of life remaining of the at least one toner cartridge is substantially the same in the high coverage mode and the low coverage mode cartridge may be determined by the cartridge life determination module. In block S616, a user is alerted to form a respective image by an image forming unit in a high coverage mode rather than a low coverage mode such that a greater amount of the toner is used in the high coverage mode than the low coverage mode in a formation of the respective image by an alert module in response to a determination of the effective amount of remaining life of the at least one toner cartridge.

Figure 7:
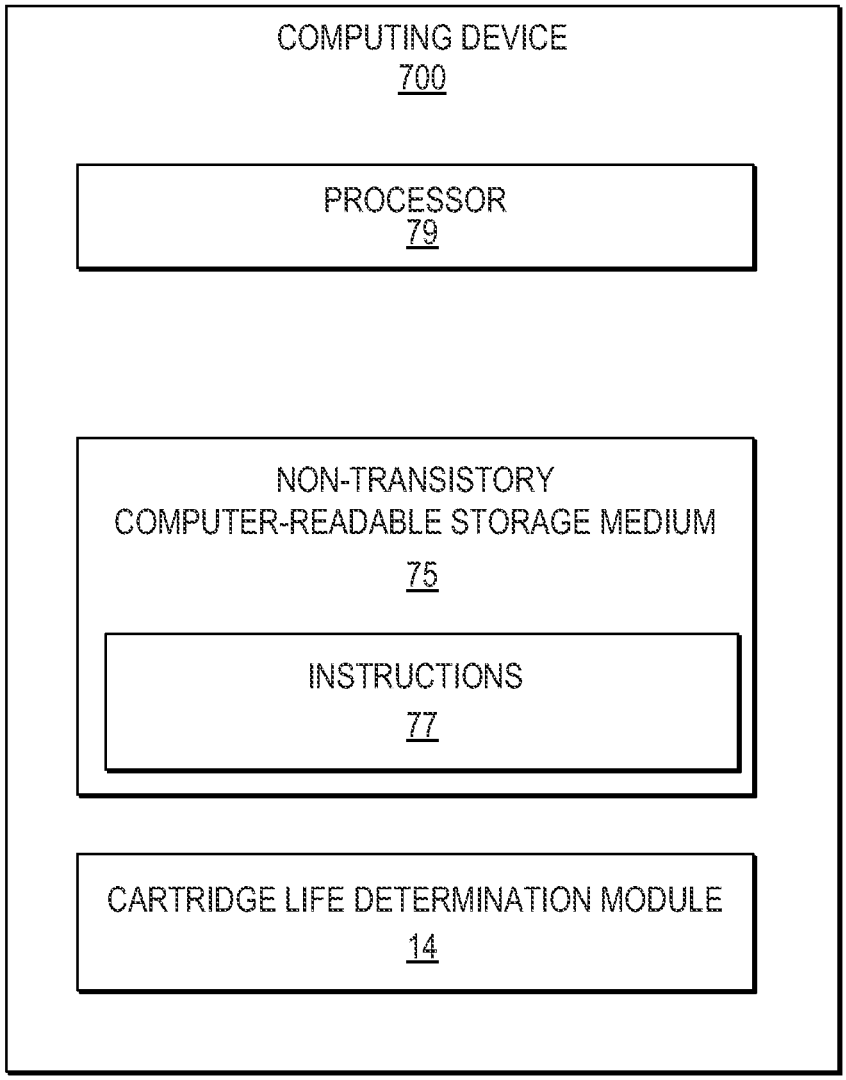
FIG. 7 is a block diagram illustrating a computing device such as an image forming system including a processor and a non-transitory, computer-readable storage medium to store instructions to operate an image forming system to alert a user of an image forming system to form an image in a high coverage mode according to an example.

FIG. 7 is a block diagram illustrating a computing device such as an image forming system including a processor and a non-transitory, computer-readable storage medium to store instructions to operate an image forming system to alert a user of an image forming system to form an image in a high coverage mode according to an example. Referring to FIG. 7, in some examples, the non-transitory, computer-readable storage medium 75 may be included in a computing device 700 such as an image forming system including a cartridge life determination module 14. In some examples, the non-transitory, computer-readable storage medium 75 may be implemented in whole or in part as instructions 77 such as computer-implemented instructions stored in the computing device locally or remotely, for example, in a server or a host computing device considered herein to be part of the image forming system.

Referring to FIG. 7, in some examples, the non-transitory, computer-readable storage medium 75 may correspond to a storage device that stores instructions 77, such as computer-implemented instructions and/or programming code, and the like. For example, the non-transitory, computer-readable storage medium 75 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 7, examples of storage devices include, but are not limited to, hard disk drives, compact disc drives, digital versatile disc drives, optical drives, and flash memory devices. In some examples, the non-transitory, computer-readable storage medium 75 may even be paper or another suitable medium upon which the instructions 77 are printed, as the instructions 77 can be electronically captured, via, for instance, optical scanning of the paper or other medium, then compiled, interpreted or otherwise processed in a single manner, if necessary, and then stored therein. A processor 79 generally retrieves and executes the instructions 77 stored in the non-transitory, computer-readable storage medium 75, for example, to operate a computing device 700 such as an image forming system to alert a user of an image forming system to form an image in a high coverage mode in accordance with an example. In an example, the non-transitory, computer-readable storage medium 75 can be accessed by the processor 79.

It is to be understood that the flowchart of FIG. 6 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 6 illustrates a specific order of execution, the order of execution may differ from that which is depicted. For example, the order of execution of two or more blocks may be scrambled relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. An image forming system, comprising:

at least one toner cartridge including toner and at least one component;

an image forming unit to selectively form an image in one of a low coverage mode and a high coverage mode such that a greater amount of the toner is used in the high coverage mode than the low coverage mode in a formation of the respective image; and a cartridge life determination module to determine an amount of remaining life of the toner, an amount of remaining life of the at least one component, and an effective amount of remaining life of the at least one toner cartridge based on the amount of remaining life of the toner and the amount of remaining life of the at least one component, the cartridge life determination module including:

a difference calculation module to calculate a difference between the amount of remaining life of the toner and the amount of remaining life of the at least one component; and a threshold identification module to identify whether the difference corresponds to a threshold value.

2. The image forming system according to claim 1, further comprising:

an alert module to alert a user to form the respective image in the high coverage mode in response to a determination of the effective amount of remaining life of the at least one toner cartridge.

3. The image forming system according to claim 2, wherein the cartridge life determination module is configured to determine whether an effective amount of life remaining of the at least one toner cartridge is substantially the same in the high coverage mode and the low coverage mode.

4. The image forming system according to claim 3, wherein the alert module is configured to alert the user to form the respective image in the high coverage mode in response to a determination that the effective amount of remaining life of the at least one toner cartridge is substantially the same in the high coverage mode and the low coverage mode.

5. The image forming system according to claim 2, wherein the at least one component comprises a developer member to provide the toner to a latent image to form a developed image on a photosensitive drum and the amount of remaining life of the developer member corresponds to a number of rotations thereof.

6. The image forming system according to claim 2, wherein the at least one component comprises a photosensitive drum in which a latent image is formed thereon and the amount of remaining life of the photosensitive drum corresponds to a number of rotations thereof.

7. The image forming system according to claim 2, wherein the alert module comprises at least one of a display and a sound generator.

8. The image forming system according to claim 2, wherein the at least one component comprises a plurality of components.

9. The image forming system according to claim 8, wherein the plurality of components comprise a photosensitive drum in which a latent image is formed thereon and a developer member to provide toner to the latent image to form a developed image on the photosensitive drum.

10. The image forming system according to claim 2, wherein the at least one toner cartridge further comprises a plurality of toner cartridges.

11. The image forming system according to claim 10, wherein the alert module is configured to alert the user to form the respective image in the high coverage mode based on a determination of the effective amount of remaining life of each one of the plurality of toner cartridges.

12. A method of alerting a user of an image forming system to form an image in a high coverage mode, the method comprising:

determining an amount of remaining life of toner in at least one toner cartridge by a cartridge life determination module;

determining an amount of remaining life of at least one component of the at least one toner cartridge by the cartridge life determination module;

determining an effective amount of remaining life of the at least one toner cartridge by the cartridge life determination module based on the amount of remaining life of the toner and the amount of remaining life of the at least one component including:

calculating a difference between the amount of remaining life of the toner and the amount of remaining life of the at least one component by a difference calculation module; and identifying whether the difference corresponds to a predetermined threshold value by a threshold identification module; and alerting a user to form a respective image by an image forming unit in a high coverage mode rather than a low coverage mode such that a greater amount of the toner is used in the high coverage mode than the low coverage mode in a formation of the respective image by an alert module in response to a determination of the effective amount of remaining life of the at least one toner cartridge.

13. The method according to claim 12, wherein the determining an effective amount of remaining life of the at least one toner cartridge by the cartridge life determination module based on the amount of remaining life of the toner and the amount of remaining life of the at least one component further comprises:

determining whether an effective amount of life remaining of the at least one toner cartridge is substantially the same in the high coverage mode and the low coverage mode cartridge by the cartridge life determination module.

14. The method according to claim 12, wherein the at least one component comprises a developer member in which a latent image is formed thereon and a developer member to provide toner to a latent image to form a developed image on a photosensitive drum and the amount of remaining life of the developer member corresponds to a number of rotations thereof.

15. The method according to claim 12, wherein the at least one component comprises a photosensitive drum in which a latent image is formed thereon and the amount of remaining life of the photosensitive drum corresponds to a number of rotations thereof.

16. The method according to claim 12, wherein the at least one component comprises a plurality of components.

17. The method according to claim 16, wherein the plurality of components comprises a photosensitive drum in which a latent image is formed thereon and a developer member to provide toner to the latent image to form a developed image.

18. A non-transitory computer-readable storage medium having computer executable instructions stored thereon to operate an image forming system to alert a user to form an image in a high coverage mode, the instructions are executable by a processor to:

determine an amount of remaining life of toner in at least one toner cartridge by a cartridge life determination module;

determine an amount of remaining life of at least one component of the at least one toner cartridge by the cartridge life determination module;

determine an effective amount of remaining life of the at least one toner cartridge by the cartridge life determination module based on the amount of remaining life of the toner and the amount of remaining life of the at least one component; and alert a user to form a respective image by an image forming unit in a high coverage mode rather than a low coverage mode by an alert module in response to a determination of the effective amount of remaining life of the at least one toner cartridge such that a greater amount of the toner is used in the high coverage mode than the low coverage mode in a formation of the respective image by:

calculating a difference between the amount of remaining life of the toner and the amount of remaining life of the at least one component by a difference calculation module; and identifying whether the difference corresponds to a predetermined threshold value by a threshold identification module.

* * * * *